US008418982B1

(12) United States Patent
Vatus

(10) Patent No.: US 8,418,982 B1
(45) Date of Patent: Apr. 16, 2013

(54) SELF SUPPORTING TABLE BASE

(76) Inventor: Jean Rene Vatus, San Jose, CA (US)

( * ) Notice: Subject to any disclaimer, the term of this patent is extended or adjusted under 35 U.S.C. 154(b) by 457 days.

(21) Appl. No.: 12/426,853

(22) Filed: Apr. 20, 2009

(51) Int. Cl.
*F16M 11/38* (2006.01)

(52) U.S. Cl.
USPC ..... 248/431; 248/188.1; 248/188.7; 248/188.8; 248/163.1; 248/188.91; 248/440; 108/158.12

(58) Field of Classification Search ..... 248/188.1, 248/188.7, 188.8, 163.1, 184.1, 431, 188.91, 248/440; 108/157.17, 158.12, 159.12
See application file for complete search history.

(56) References Cited

U.S. PATENT DOCUMENTS 583,013 A * 5/1897 Ebert ..... 248/431
595,686 A * 12/1897 Allgauer ..... 403/170
1,977,848 A * 10/1934 Gwynn ..... 108/159.12
2,749,147 A * 6/1956 Herrschaft ..... 248/431
2,759,780 A * 8/1956 Barker, Jr. ..... 108/157.17
2,841,352 A * 7/1958 Pappas ..... 108/157.18
3,267,889 A * 8/1966 Bedol ..... 108/157.15
3,396,933 A * 8/1968 Ward ..... 248/431
3,643,608 A * 2/1972 DeCesaris ..... 108/153.1
4,423,849 A * 1/1984 Jordan ..... 248/165
4,717,108 A * 1/1988 Liedle ..... 248/432
D295,005 S * 4/1988 Murry ..... D6/498
5,102,077 A * 4/1992 Glendinning ..... 248/164
D384,222 S * 9/1997 Cheng ..... D6/403
6,047,931 A * 4/2000 Flanagan et al. ..... 248/127
6,182,650 B1 * 2/2001 Tuttle ..... 126/30

* cited by examiner

*Primary Examiner* — Terrell McKinnon
*Assistant Examiner* — Michael McDuffie

(57) ABSTRACT

A self supporting structure which may be used to support a platform such as a table top utilizes a plurality of elongated members and a ring. Each elongated member has one end resting on the floor on one point of a circumference, and the other end supporting the platform above the floor on a point substantially diametrically opposed. The elongated members cross each other proximate the center of the structure in a frictional and locking engagement maintained by the ring. That zone of convergence and the engagement of the elongated members between each other provide the only support for the structure which is self-supporting without extraneous means such as screw, glue or the like. The structure leave the floor below the edges and corners of the table top it supports free from interference with the legs of people seated at the table.

11 Claims, 10 Drawing Sheets

SELF SUPPORTING TABLE BASE

CROSS REFERENCE TO RELATED APPLICATION

Not Applicable

FEDERALLY SPONSORED RESEARCH

Not Applicable

SEQUENCE LISTING

Not Applicable

BACKGROUND OF THE INVENTION

1. Field of the Invention

This relates to a collapsing supporting structure which can be used as a support for a platform such as a table.

2. Prior Art

The mobility of furniture, especially outdoor furniture, is often limited by the heaviness and the bulkiness in its construction. For example, some tables are difficult to move from one site to another without the aid of several persons, and transportation can leads to an alteration of the structure. In this regard, furniture which can be disassembled or folded possesses the advantage of being transported and stored easily. Many collapsible furniture designs have been proposed. In the U.S. Pat. No. 4,824,058 dated Apr. 25, 1989 and No. 5,074,502 dated Dec. 24, 1991, it is disclosed a table base structure comprising of elongated members extending angularly relative to each other, and connected between each other proximate the center of the base using a pair of slots included in elongated members. Stability and robustness of the structure are provided by the wideness of the elongated members, and by the large area the structure covers on the ground. Consequently this table base does not leave the floor below the edges and the corners of the table it support free from interference with the legs of the people sitting around. Other prior attempts have been made to provide supporting structure comprising of elongated members extending angularly with each other, useful for example, as a camera stand, a plant stand or the like, but are not applicable for holding with the require stability and robustness a dining table top. The U.S. Pat. No. 4,423,849 dated Jan. 3, 1984 discloses a self supporting structure utilizing three legs extending through a clinch plate including three holes of larger dimension than the legs and arranged in an equilateral triangle for the reception of the three legs. The three holes extend through the clinch plate at angles which direct the legs into a frictional and locking engagement with each other.

It does not appears that any prior art known to applicant have provided a detachable self supporting structure using a plurality of members extending in angular relation to each other, crossing each other proximate a center, held together in frictional and locking engagement, with a simple device such as a ring, and tilted from the floor at an angle small enough to leave the edges of the table top it supports free from interference with the legs of the people sitting around. In these respects, the supporting structure set according to the present application departs from conventional concepts and designs of the prior art, and in so doing provides an apparatus primarily developed for the purpose of allowing the user to easily assembly and take apart the supporting structure suitable for a dining table top.

SUMMARY

A support structure utilizes a plurality of elongated members extending angularly relative to each other, and surrounded by a ring adjacent to the middle of the support structure. Corresponding ends of the elongated members rest on a supporting surface and the other ends of the elongated members may support a platform or a table top.

The form and size of the cross section of the elongated members are being determined in conjunction with the angle relative to each other, the size and shape of the ring, and the number of elongated members used in the support structure, as to force the elongated members into a frictional and interlocking engagement between each other.

BRIEF DESCRIPTION OF THE DRAWINGS

FIG. 5 is a portion of an elongated member illustrating the detail of a groove in which a segment of an external ring shown in FIG. 4A may be slotted in.

DETAILED DESCRIPTION OF THE PREFERRED EMBODIMENTS

In the following description, various aspects will be described, and various details set forth in order to provide a thorough understanding of the present invention. Reference in this specification to "one embodiment" or "an embodiment" means that a particular feature or structure described in connection with the embodiment is included in at least one embodiment of the invention. The appearances of the phrase "in one embodiment" in various places in the specification are not necessarily all referring to the same embodiment, nor are separate of alternative embodiments mutually exclusive of other embodiments. Moreover, various features are described which may be exhibited by some embodiments and not by others.

Figure 1:
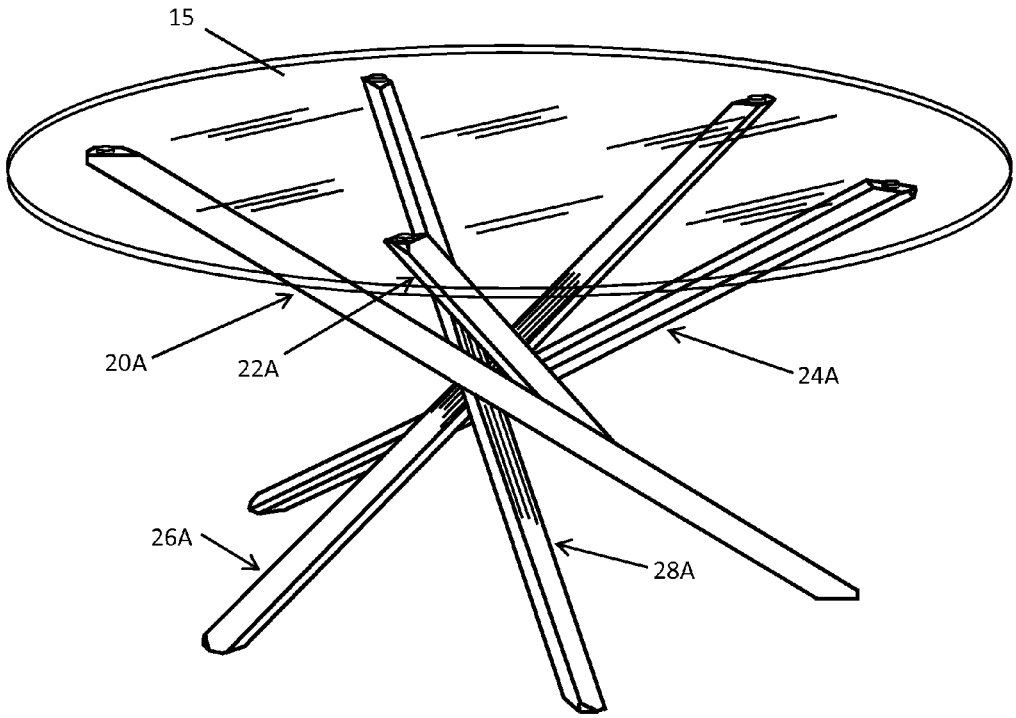
FIG. 1 is a perspective view of one embodiment of a self supporting structure.
Figure 2:
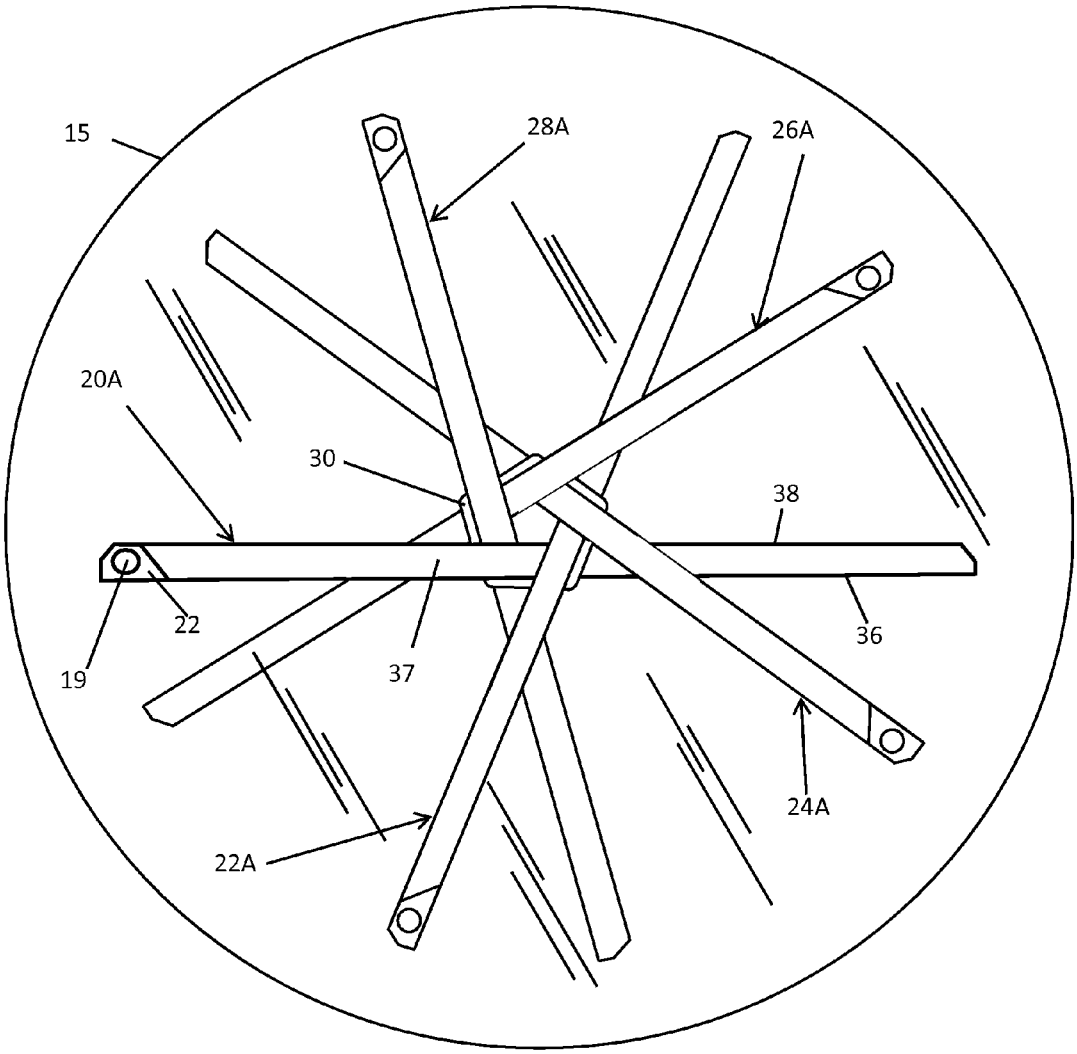
FIG. 2 is a top plane view of the supporting structure shown in FIG. 1.
Figure 3:
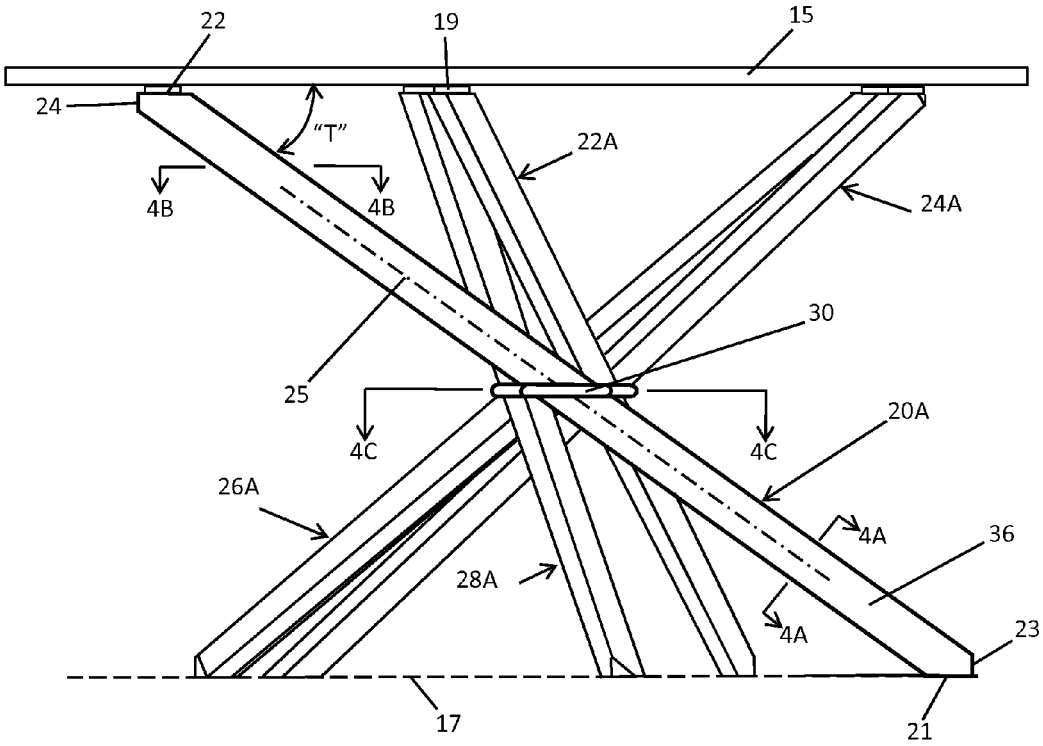
FIG. 3 is a side elevation view of the supporting structure shown in FIG. 1.

Referring more specifically to the drawings, as a whole, one embodiment of the self supporting structure is depicted by reference characters 20A, 22A, 24A, 26A, 28A and 30 in the top plane view in FIG. 2 and the side elevation view shown in FIG. 3. Elongated members 20A, 22A, 24A, 26A and 28A extend at common angles relative to each other through an external ring 30, and support a transparent table top 15. In the top plane view shown in FIG. 2 the reader can see that elongated members 20A, 22A, 24A, 26A, and 28A are substantially identical. Thus, any description regarding elongated member 20A also applies to elongated members 22A, 24A, 26A and 28A. A perspective view of the supporting structure is depicted in FIG. 1.

The side elevation view of the self supporting structure in FIG. 3, shows an orthogonal view of elongated member 20A. It is to be noticed that the elongated members are not perpendicular, neither parallel between each other, therefore in FIG. 3, elongated members 22A, 24A, 26A and 28A are not seen in an orthogonal view. The elongated member 20A comprises four sides which extend along an axis 25. Side 36 terminates at the lower end at the intersection with a flat surface 21 resting on a supporting surface 17, and at the intersection with a flat surface 23 substantially perpendicular to flat surface 21. At the upper end, side 36 terminates at the intersection with a flat surface 22, which is parallel to transparent table top 15, and at the intersection with a flat surface 24 substantially perpendicular to flat surface 22. Returning to FIG. 2, side 37 of elongated member 20A is seen extending between side 36 and side 38, along the axis 25. Sides 35 (not shown in FIG. 2) extended along axis 25 shown in FIG. 3, between sides 36 and 38 oppositely to side 37. It should be noticed that a cushion 19 separates flat surface 22 from transparent table top 15.

Elongated members extend from their upper end to their lower end and cross each other proximate the center of the self supporting structure through ring 30. The tilt angle between the elongated members and platform 15, is depicted by the reference character "T" seen at the upper left end of FIG. 3.

Although the term "ring" is used to describe the component 30, it is contemplated that the shape of this component does not need to be circular and may include any shape including but not limited to rectangles, polygons, ovals, and the like. In some embodiments, the ring is made of brass, but it may be formed of any rigid material, including but not limited to, other metal, wood, and plastic. The ring may also be a closed loop of any non elastic flexible material such as a rope, cord, metal string, and the like.

Figure 4A:
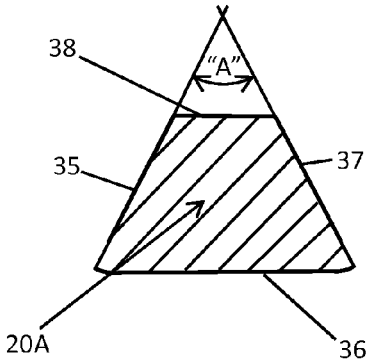
FIG. 4A is an orthogonal sectional view of an elongated member taken at the sectional plane indicated by the section line 4A-4A in FIG. 3.
Figure 4B:
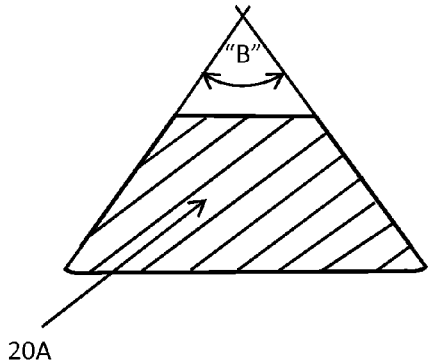
FIG. 4B is a horizontal sectional view of an elongated member taken at the sectional plane indicated by the section line 4B-4B in FIG. 3.
Figure 4C:
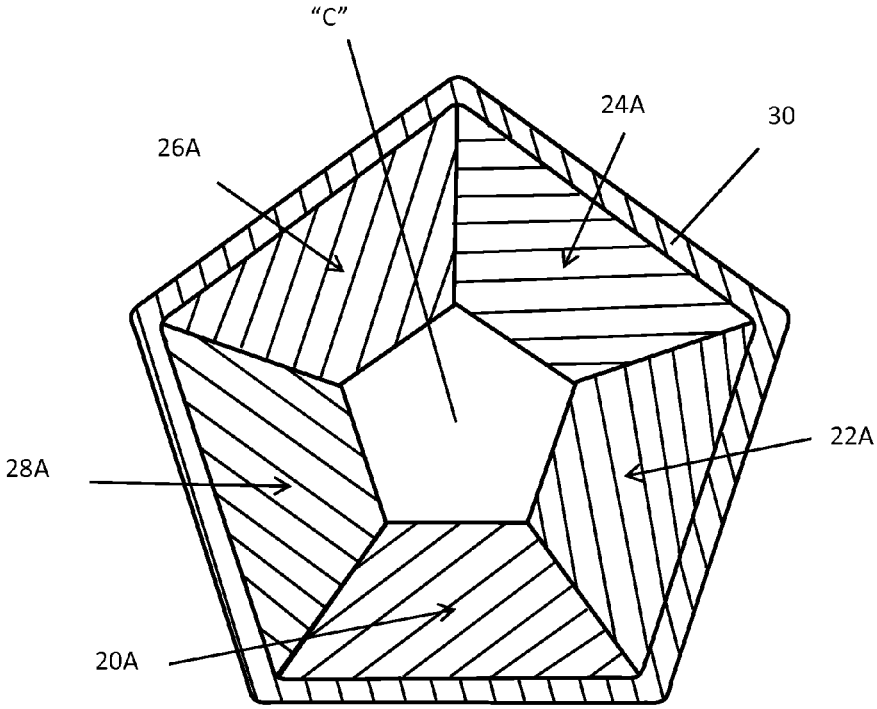
FIG. 4C is a sectional view of the supporting structure as seen in FIG. 3, taken at the sectional plane indicated by the section line 4C-4C.

Cross-sectional views of elongated members are shown in FIGS. 4A, 4B and 4C. FIG. 4A shows a sectional view of elongated member 20A of FIG. 2 taken at the sectioning plane orthogonally oriented relative to the axis 25 and in the direction indicated by section lines 4A-4A. The cross-section view in FIG. 4A will be referred in the continuation of this description as the "orthogonal cross-section" of elongated members. FIG. 4B shows a sectional view of elongated member 20A of FIG. 3 taken at the sectional plane parallel to platform 15 and in the direction indicated by section lines 4B-4B. The cross-section view in FIG. 4B will be referred in the continuation of this description as the "horizontal cross-section" of elongated members.

FIG. 4C is a cross-sectional view of the assembled supporting structure taken at the sectioning plane parallel to platform 15, and in the direction indicated by section lines 4C-4C in FIG. 3. FIG. 4C shows a cross section of five elongated members together taken at the horizontal plane crossing the external ring 30. This view defines a center point "C" of the assembled self supporting structure.

With reference again to FIG. 4A, it may be observed that the orthogonal cross-section of elongated members describes the manufacturing cross-section. The four sides 36, 38, 35 and 37 extending along axis 25 seen in FIG. 3 are depicted: the external side 36 also seen in FIG. 3, the internal side 38 positioned oppositely to side 36, a left side 35, and a right side 37. Right side 37 is also seen also in the top plane view of the supporting structure depicted in FIG. 2. An angle "A" between left side 35 and right side 37 provides a trapezoidal shape to the elongated member cross-section. It is presently contemplated in a preferred embodiment that the four sides 35-38 extended along axis 25 of elongated member 20A are flat surfaces and that elongated member cross section is trapezoidal. However, elongated member cross section may have different shapes as long as they can be pressed together by a ring or the like in a frictional and locking engagement. Elongated member cross section may not be uniform along axis 25 and may be rectangular, oval, circular, etc., or any other shape, as long as a frictional and locking engagement between elongated members is ensured inside ring 30. Side 38 facing center "C" does not mechanically contribute to the robustness, stability and stiffness of the supporting structure, and can have any shape. It may be observed in FIG. 4C that all sides 36 of elongated members are in contact with ring 30. Therefore, if ring 30 is made of a rigid material, the shape of side 36 proximate ring 30, and the shape of ring 30 need to be define accordingly with each other.

In the purpose of making a complete disclosure, it is bring to the reader attention that in the preferred embodiments, there is a relation between the number "N" of elongated members used in the supporting structure which may be any number equal or greater than 3, the tilt angle "T" between elongated members and a supporting surface, and the angle "A" and "B" of the elongated members orthogonal and horizontal cross sections.

Angle "B" of the horizontal cross-section is only function of the number "N" of elongated members constituting the support structure, and is given in radian by the formula:

$$B=2\pi/N.$$

To obtain the desired angle "B" when elongated members are tilted at angle "T", the angle "A" of the orthogonal cross section needs to be determined, and may be provided in radian by the formula:

$$A=2\times\tan^{-1}[\tan(\pi/N)\times\cos(\pi/2-T)].$$

For example, to support with five elongated members a 60" diameter circular platform at the height of 27", a tilt angle "T" of 36° may be used. For the angle "B" to be equal to 360°/5=72°, elongated members may be manufactured with an angle "A" between left side 35 and right side 37 proximate to 46°. Elongated member length being measured along axis 25 between flat surface 21 and flat surface 22 may be proximate to 46".

Figure 5:
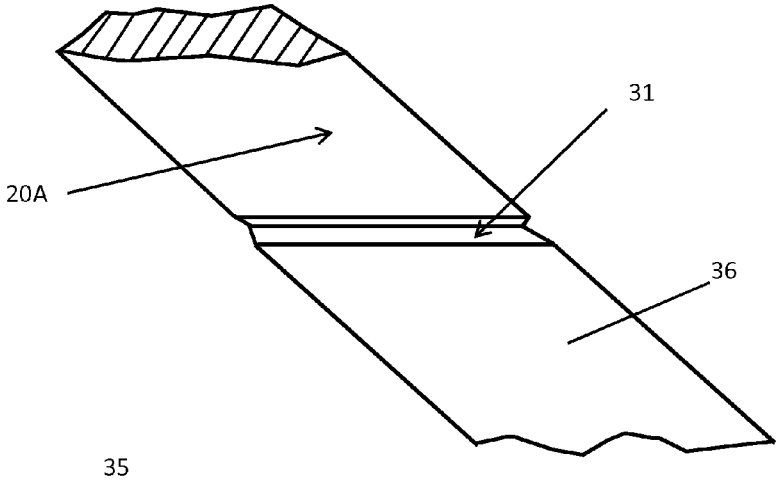

In some embodiments, elongated members 20A, 22A, 24A, 26A and 28A may include a groove 31 as it may be seen in FIG. 5, showing a partial view of elongated member 20A.

Groove 31 is substantially parallel to flat surfaces 21 and 22 and may be positioned proximate the middle of elongated member length to set the position of ring 30 so that all portions of elongated members above and below ring 30 are the same when the self supporting structure is assembled. Groove 31 may have a V shape as it is depicted in FIG. 5 but any other shapes in conjunction with the section of ring 30 may be used.

Figure 6A:
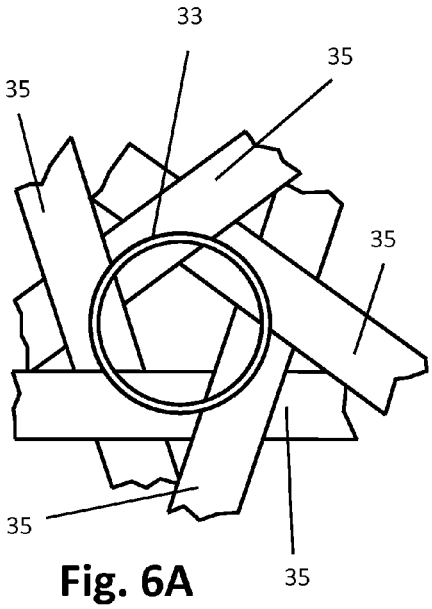
FIG. 6A shows partial bottom plane view of the elongated members crossed proximate the center of the structure and together with an internal ring.
Figure 6B:
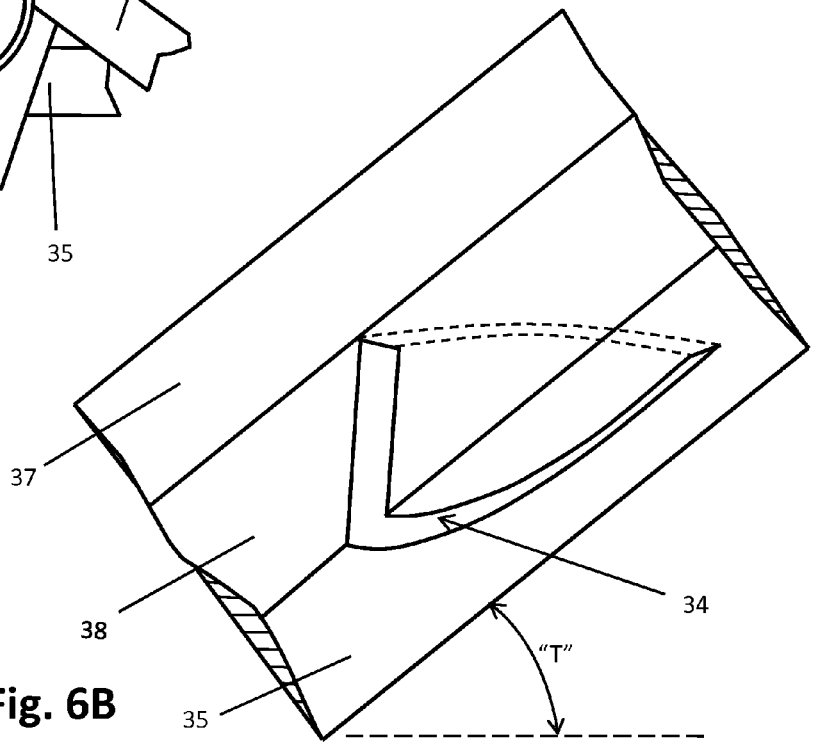
FIG. 6B shows the recess in an elongated member in which an internal ring may be inserted.

In some embodiments, a ring may be inserted in the elongated members instead of being around them, and still presses together the elongated members and ensures a frictional and locking engagement between each other. FIG. 6A is a partial bottom plane view of the structure showing elongated members left sides 35 and an internal ring 33 inserted inside recesses included in elongated members. A plane view of recesses when elongated members are tilted in operation may have the shape of a segment of a circle so that when elongated members are crossed, all recesses together form a complete circle. Ring 33 may be then placed into the circular recess formed by all individual recesses together. FIG. 6B is a partial orthogonal view of an elongated member in operation having the tilt angle "T" with the supporting surface, showing three sides and the recess 34. Side 38 is the internal side facing the center "C" of the structure, and sides 35 and 37 are the left and the right sides having the angle "A" between each other as it is described in FIG. 4A. Recess 34 extends on side 38, substantially vertically from the intersection with side 35 to the intersection with side 37, and extends horizontally as shown by the hidden lines in FIG. 6B, forming an arc of a circle to end proximate the middle line of side 35.

The supporting function of the structure is ensured by external ring 30 or internal ring 33 providing the frictional and locking engagement of the elongated members between each other. The weight of the table top 15 aids in the stability of the supporting structure. However, it should be noticed that external ring 30 or internal ring 33 is subjected to a tensile force exerted by the elongated members, and that the material it is made from needs to be chosen accordingly. External ring 30 or internal ring 33 may be a polygon having N sides, with N equal to the number of elongated members or may be a circle.

Any elongated members of the self supporting structure shown as a whole in FIG. 1, FIG. 2 and FIG. 3 may be interchanged, and in the absence of cushions 19 may be turned upside down. It is to be noticed, that the number N of elongated members comprising the self supporting structure is not limited to five, and may be any number equal to or greater than three.

Figure 7A:
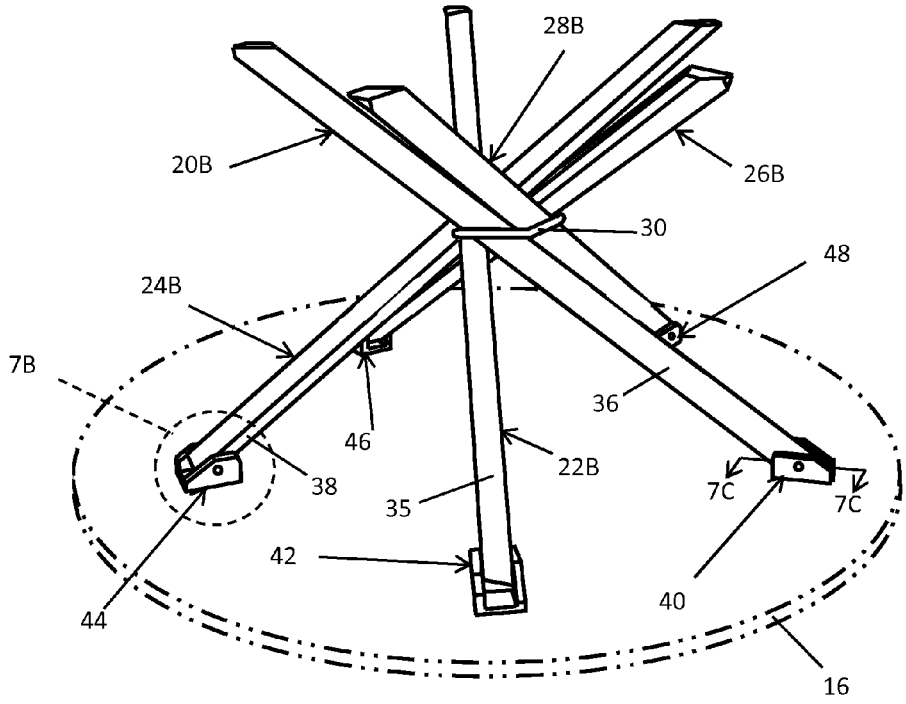
FIG. 7A is a perspective view of an embodiment of a supporting structure shown upside down, with attachment elements between each elongated members and the supported platform.

With reference from FIG. 7A to FIG. 10C an other embodiment of a supporting structure attached to a platform 16 is described. FIG. 7A is a perspective view of the structure shown upside down, to depict the attachment assemblies or attachments 40, 42, 44, 46 and 48, connecting the elongated members 20B, 22B, 24B, 26B and 28B, to the platform 16. All elongated members as well as all attachments are substantially identical. Thus any description regarding elongated member 20B also applies to elongated members 22B, 24B, 26B and 28B. Similarly, any description regarding attachment 40, 42, 44, 46 or 48 also applies to any others. It is to be noticed, that the number N of elongated members comprising the supporting structure is not limited to five, and may be any number equal to or greater than three.

Figure 7B:
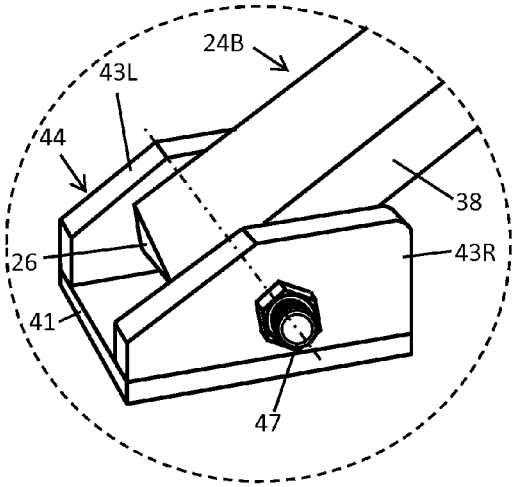
FIG. 7B is a detailed view of the portion indicated by the dashed circle with the reference 7B in FIG. 7A
Figure 7C:
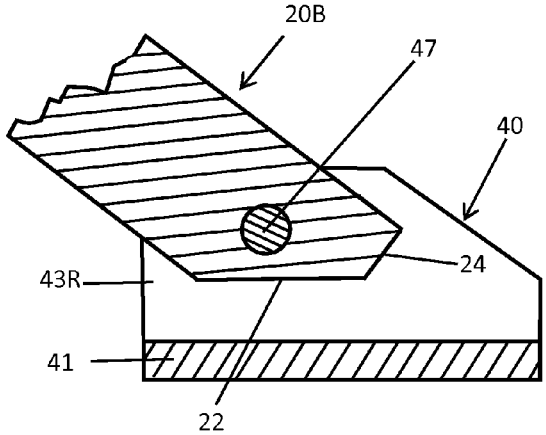
FIG. 7C is a sectional view showing one end of an elongated member and its connection at the sectional plane indicated by the section line 7C-7C in FIG. 7A
Figure 8:
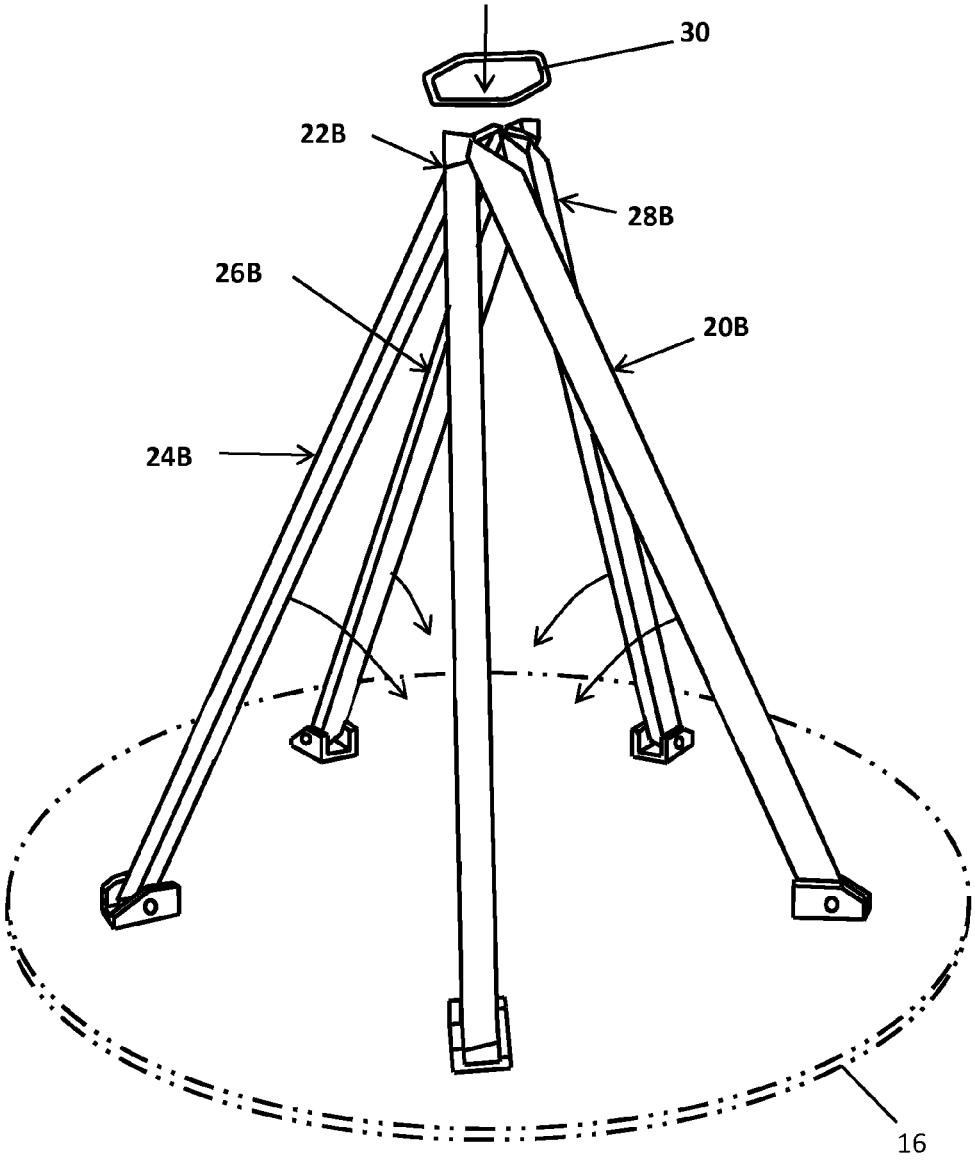
FIG. 8 shows an embodiment of the supporting structure in the process of being locked with an external ring.

The connection between elongated members and attachments is depicted in FIG. 7B,7C. An enlarge perspective view of attachment assembly 44 and one end of elongated 24B may be seen in FIG. 7B referenced to a dashed circle in FIG. 7A. FIG. 7C shows a cross-sectional view of attachment 40 in FIG. 7A, taken at the sectional plane and in the directions indicated by section lines 7C-7C. Attachments comprise a base 41, a right flange and a left flange, 43R and 43L, and a pivot 47. Base 41 lies on one face, and is attached to the platform 16 in any suitable manner. Flanges 43R and 43L are vertically positioned and fastened on each side of the opposite face of base 41 and flush the edges of base 41, so that the cross section of the three elements 41, 43R and 43L may form a "U" shape, indicated at 42 in FIG. 7A or at 44 in FIG. 7B. Flanges 43R and 43L are parallel with a distance between each other at least equal to the distance between elongated member side 36 and elongated member side 38. Elongated member side 36 faces the inner side of flange 43L, and elongated member side 38 faces the inner side of flange 43R. Two holes, one in each flange, extend along a common axis, and are substantially perpendicular to the flanges internal faces. A hole of a similar diameter extends through the elongated member proximate its end, and perpendicularly to side 36 and side 38. A pivot 47 which may be made of a bolt and nut, a pin or the like, extends through the flanges holes and through the elongated member hole. Similarly to previous embodiments, elongated member side 36 terminates at the intersection with a flat surface 22 and at the intersection with a flat surface 24. Elongated members are held by pivots 47, flat surface 22 is substantially parallel to plate 41 and distant enough from plate 41 to avoid contact when elongated members rotates around pivot 47. In operation, the user may remove or install the external ring 30 around elongated members as it is illustrated in FIG. 8. The ends of the elongated members attached to the platform are restrained from any movement except partial rotation around pivots 47. Therefore, when ring 30 is sliding down, the opposite ends of elongated members spread out until a frictional and locking engagement occurs between elongated members inside ring 30. Similarly, with internal ring 33, the user crosses the elongated members until all elongated members right sides are in contact and form a common plane with the adjacent elongated member left side. All recesses 34 form a circle, and the internal ring 33 is then placed and pushed inside the recesses.

Figure 9A:
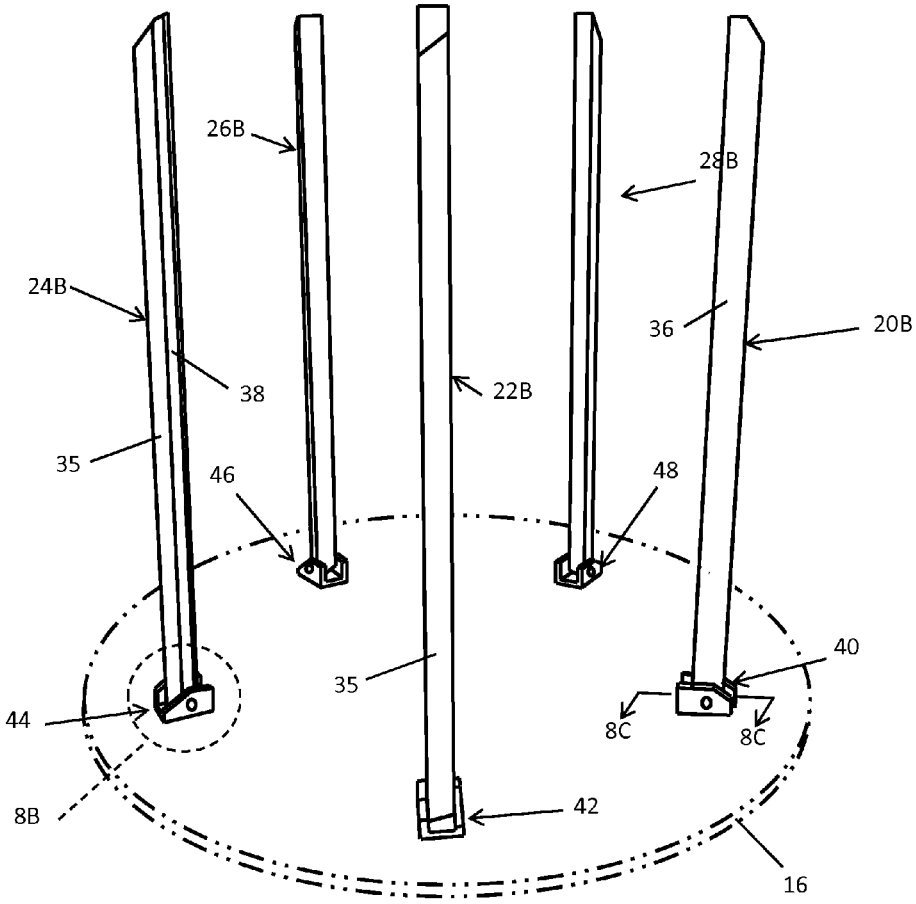
FIG. 9A, FIG. 9B and FIG. 9C show the embodiment depicted in FIGS. 7A 7B and 7C, with the elongated members being spread out.
Figure 9B:
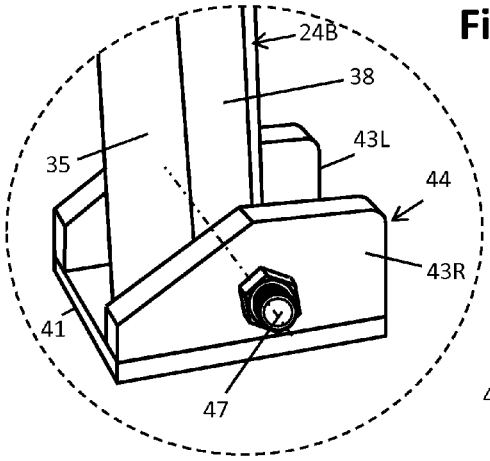
Figure 9C:
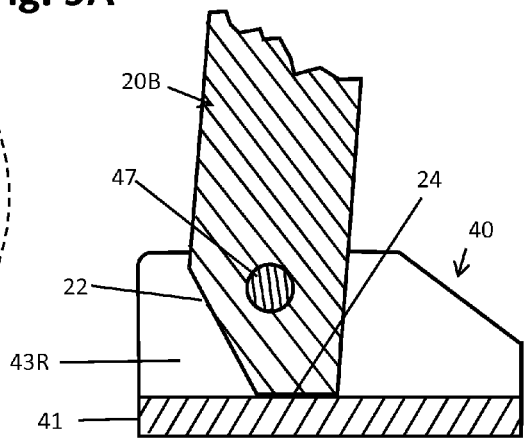

Turning to FIGS. 9A, 9B and 9C, the same embodiment is depicted with elongated members spread in an extension position. It may be observed on the cross-sectional view of FIG. 9C that elongated members rotation around pivot 47 is limited by the contact between flat surface 24 and base 41 of the attachment 40. The position of pivot 47 in the attachment 40 is being determined in conjunction with the position of the hole of elongated member 20B in respect with flat surface 24, so that the maximal angle "T" between platform 16 and elongated members is substantially equal to 90° as illustrated in FIG. 9A.

Figure 10A:
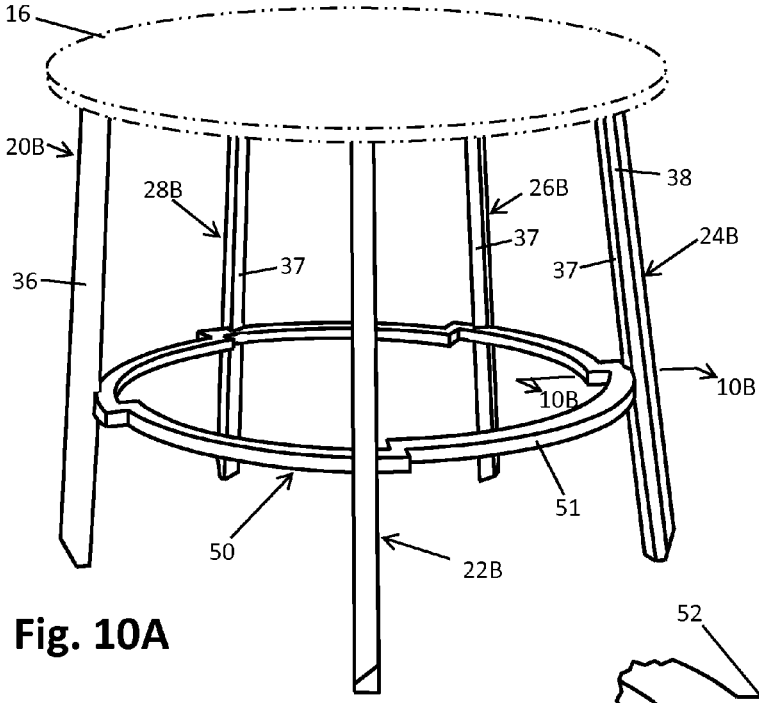
FIG. 10A is a perspective view of the second embodiment with the supporting structure spread and locked into its highest position.

In spreading position, elongated members orientation being substantially vertical, the platform 16 may be elevated to a height approximately equal to elongated members total length. FIG. 10A is a perspective view of an embodiment of a supporting structure showing elongated members spread out and secured in extending position with a spreader 50. Although spreader 50, shown as an example in FIG. 10A, has an circular shape with several segments, it is contemplated that the shape of this element does not need to be circular and may include various shapes including but not limited to polygons, disks, rays and the like. Spreader 50 may comprise an external face 51 shown in FIG. 10A, an upper face 52 and a lower face 53 shown in the cross-sectional view in FIG. 10B, taken at the sectional plane and in the directions indicated by section lines 10B-10B.

Figure 10B:
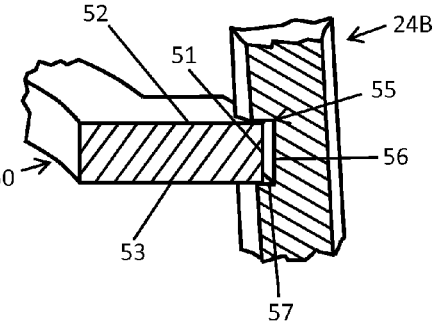
FIG. 10B is a cross-sectional view of the spreader and an elongated member.

Along external face 51, the spreader circumference comprises several segments separated with steps. Between steps, the radius of the segment measured along the external face 51 varies from a small radius to a large radius. As seen in FIG. 10B, elongated member 24B includes a slot 55 which comprises a wall portion 56, and a floor portion 57. Wall portion 56 and floor portion 57 are depicted as being flat and extending from side 36 and opposite side 38. In FIG. 10A, side 36 is shown on elongated member 20B, and side 38 is shown on elongated member 24B. Thus the transverse distance along wall 56 is at least equal to the thickness along external face 51 of spreader 50. In operation, elongated members are spread with flat surfaces 24 in contact with plates 41, and the user may position the spreader inside the structure with the smaller radius of each segment facing the slot 55 of each elongated member, and rotates the spreader until segment sides 51 and walls 56 contact each other. In the cross-sectional view in FIG. 10B, the relative amount of clearance between spreader segment side 51 and slot wall 56 is exaggerated for the purposes of illustration.

Figure 10C:
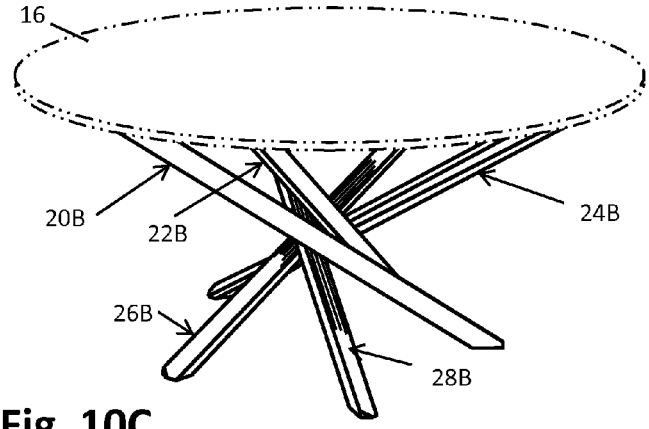
FIG. 10C is a perspective view of an embodiment with the supporting structure folded and locked into its lower position.

At this point of the description, it may be obvious that in this embodiment set forth, the supporting structure may be used alternatively with a ring or with a spreader, and that platform 16 may be risen at two different heights. Turning to FIG. 10C, the supporting structure is shown with elongated members in crossing position locked with internal ring 33 (not shown), and platform rises at the lowest height.

For example, the same structure comprising five elongated members may support a platform at a height proximate 19" (coffee table top height) with elongated members in crossing position, and at a height proximate to 39" (pub table top height) with elongated members in extended position. In FIGS. 3 and 4A, the manufacturing angle "A" between elongated members left side 35 and right side 37 may be equal to 40°, the tilt angle "T" of elongated members in crossing position may be equal to 30°, and elongated member length being measured along axis 25 between flat surface 21 and flat surface 22 may be equal to 39".

Figure 11A:
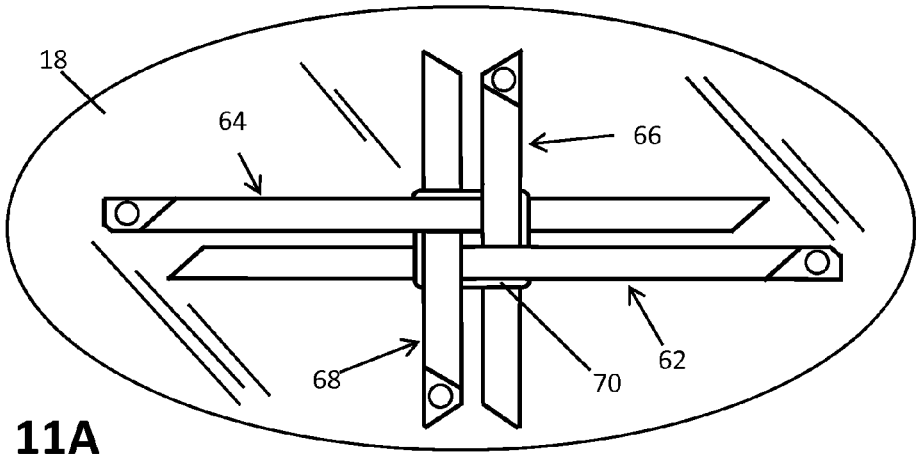
FIG. 11A, FIG. 11B and FIG. 11C are respectively a top plane view, a front elevation and a side elevation of another embodiment of the supporting structure.
Figure 11B:
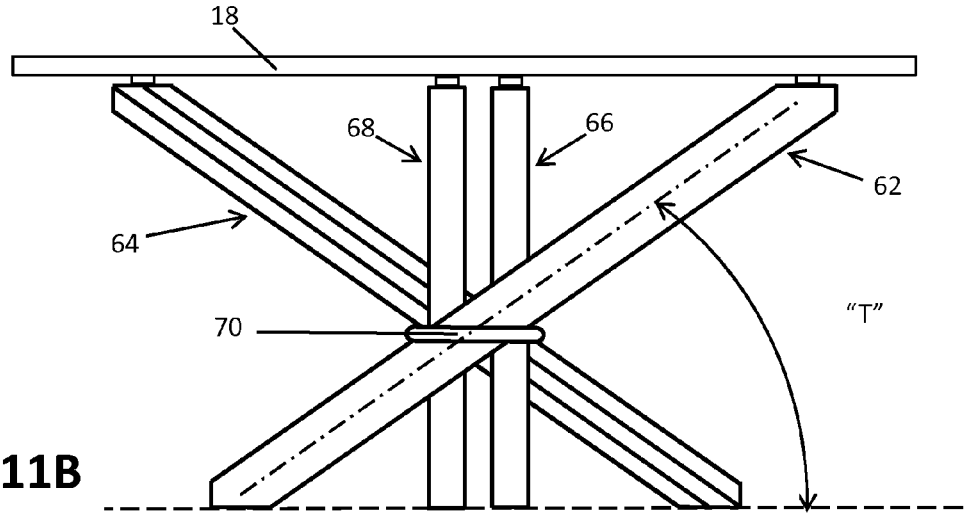
Figure 11C:
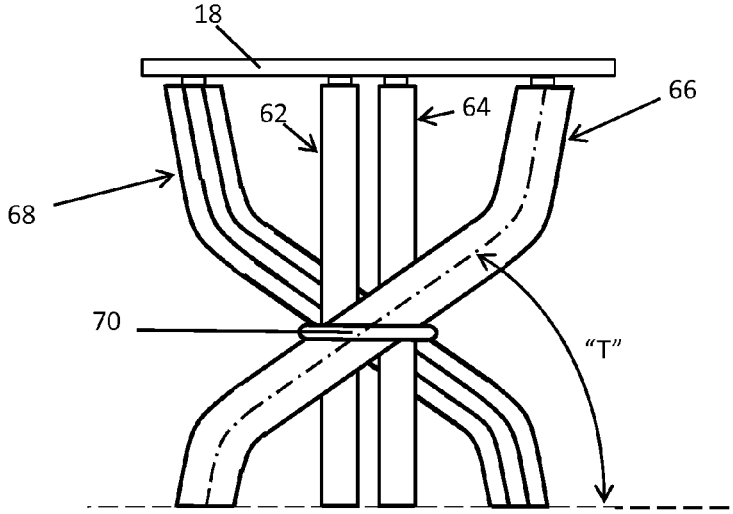

Turning now to FIG. 11A, FIG. 11B and FIG. 11C, an embodiment is shown in which two different pairs of elongated members are used to support an oblong platform. The top plane view of the supporting structure is shown in FIG. 11A. Two long elongated members 62 and 64 support the platform 18 along its length, and are shown in a side elevation view depicted in FIG. 11B with a straight axis and a tilt angle "T". Two short elongated members 66 and 68 support the platform 18 along its width, and are shown in a side elevation view depicted in FIG. 11C with a curved axis. A ring 70 having a rectangular circumference surrounds the elongated members 62, 64, 66 and 68 proximate half the height of platform 18. It may be obvious that side elevation views in FIGS. 11B, 11C are 90° from each other. Although the axes of long elongated members 62 and 64 are shown straight, it is contemplated that they may be curved in any direction above and below ring 70. Similarly, axis of short elongated members 66 and 68 shown curved in FIG. 11C may be straight or curved in any direction below and above ring 70. Referring again to FIGS. 4A, 4B showing horizontal and orthogonal cross-sectional views of elongated members in previous embodiments, the same concept is applied here to determine the angles "A" and "B", in conjunction with the tilt angle "T" and the number of elongated members. It should be understood that proximate ring 70, angle "A" of the orthogonal cross section, angle "B" of the horizontal cross section, and tilt angle "T" of the two pairs of elongated members need to be substantially identical to ensure a frictional and locking engagement of the elongated members inside ring 70.

While certain exemplary embodiments have been described and shown in the accompanying drawings for the purpose of making a complete disclosure of the current invention, it is to be understood that such embodiments are merely illustrative and not restrictive. It will become apparent to those skilled in the art that modifications and changes are possible without departure from the scope and spirit of the invention. It is intended that the following claims be interpreted to embrace all such modifications.

What is claimed is:

1. A support structure comprising:

a. a plurality of elongated members having a predetermined length and axis, the elongated members extending above a supporting surface at an angle "T" between said axis and said supporting surface, and extending angularly relative to each other, and crossing each other contiguously proximate a line perpendicular to said supporting surface, b. a ring having a predetermined shape for pressing together said elongated members proximate said line perpendicular to said supporting surface, each of said elongated members comprising:

three or more member sides extending parallel to said axis, an orthogonal cross section substantially perpendicular to said axis, said orthogonal cross section comprising two sides having an angle "A" between each other, an horizontal cross section substantially parallel to said supporting surface when said elongated member is tilted at said angle "T" with said supporting surface, said horizontal cross section comprising two sides having an angle "B" between each other, each of said elongated members having a recess formed therein, each said recess being formed in an internal member side of the elongated member such that said recesses form a continuous recess when said elongated members cross each other contiguously proximate said line perpendicular to said supporting surface, and being tilted above said supporting surface at said angle "T", and wherein said ring is inserted inside said continuous recess, said angle "A" being predetermined for said angle "B", to be substantially equal to 360° divided by the number of said elongated members included in said support structure when said elongated members are tilted at said angle "T", said ring confining said elongated members, and providing a frictional and interlocking engagement between said elongated members, wherein said elongated members are frictionally engaged between each other, interlocked, and crossing each other contiguously proximate said line perpendicular to said supporting surface, and being tilted above said supporting surface at said angle "T".

2. The support structure of claim 1 wherein said elongated members comprise:

four member sides extending parallel to said axis, and said orthogonal cross section to said axis having a trapezoidal shape comprising two sides of different lengths substantially parallel to each other, and two sides of substantially equal lengths having an angle "A" between each other, said horizontal cross section having a trapezoidal shape comprising two sides of different lengths substantially parallel to each other and two sides of substantially equal lengths having said angle "B" between each other, said four member sides comprising two member sides of different areas substantially parallel between each other and substantially perpendicular to said supporting surface, and two member sides of substantially the same areas having said angle "A" between each other, said two member sides having said angle "A" between each other comprising a lower face member side facing said supporting surface and an upper face opposite to said supporting surface.

3. The support structure of claim 1 wherein said continuous recess has a circular shape and said ring has a circular shape.

4. The support structure of claim 2 wherein said elongated members have substantially the same length, and include a first end portion and a second end portion, said first and second end portions each including a surface substantially parallel to said supporting surface.

5. The support structure of claim 1, including a platform of rigid material and means for attaching said elongated members of said structure to the underside of said platform at spaced locations so as to support said platform parallel to said supporting surface.

6. A support structure comprising

N linear, elongated members (N≧3), each having a selected length and extending above a supporting surface at a selected angle relative to the supporting surface at a first end of each member, each said member having an upper side opposite to said supporting surface and a lower side facing said supporting surface, the N members intersecting with each other in a first plane that is spaced above the supporting surface; where the second ends of the N members lie substantially in a second plane each of the N members having a recess formed in an internal side thereof proximate said first plane, said recess forming a segment of a continuous recess disposed proximate said first plane when said members are tilted at said selected angle relative to said supporting surface, and a ring having a selected shape and size substantially the same as the shape and the size of said continuous recess and said ring being inserted inside said continuous recess, said ring holding the N members together so that each elongated member is in contact with a upper adjacent elongated member and a lower adjacent elongated member, said upper side of each member is in contact with the lower face side of its upper adjacent member, and the lower side of each member is in contact with the upper side of its lower adjacent member, and said ring providing a frictional and interlocking engagement between the N members, the N members being frictionally engaged between each other and interlocked, define an N-sided polygon that lies substantially in the first plane.

7. The structure of claim 6, wherein said first plane is substantially parallel to said supporting surface.

8. The structure of claim 6, wherein said second plane is substantially parallel to said supporting surface.

9. The structure of claim 6, wherein said shape of said continuous recess and said shape of said ring are an N-sided polygon.

10. The structure of claim 6, wherein said shape of said continuous recess and said shape of said ring are substantially a circle.

11. The structure of claim 6, wherein each of said N members has substantially the same length.

* * * * *